United States Patent [19]

Falk

[11] Patent Number: 4,735,470

[45] Date of Patent: Apr. 5, 1988

[54] REFRIGERATOR INCLUDING A SECONDARY FOOD STORAGE ARRANGEMENT

[75] Inventor: Donald G. Falk, Taylorsville, Ky.

[73] Assignee: General Electric Company, Louisville, Ky.

[21] Appl. No.: 845,512

[22] Filed: Mar. 28, 1986

[51] Int. Cl.[4] ..... A47B 88/04

[52] U.S. Cl. ..... 312/246; 312/214; 312/311; 312/345

[58] Field of Search ..... 312/246, 345, 342, 116, 312/214, 311; 62/DIG. 11

[56] References Cited

U.S. PATENT DOCUMENTS

| | | | |
|---|---|---|---|
| 2,006,442 | 7/1935 | Connors | 62/DIG. 11 X |
| 2,103,885 | 12/1937 | Whalen | 312/246 X |
| 2,177,522 | 10/1939 | Fletcher | 62/DIG. 11 X |
| 2,207,115 | 7/1940 | Carr | 312/246 |
| 2,292,865 | 8/1942 | Boddy | 312/246 X |
| 2,484,997 | 10/1949 | Heidenblut | 312/345 |
| 2,509,613 | 5/1950 | Philipp | 62/DIG. 11 X |
| 2,530,876 | 11/1950 | Harris | 312/246 |
| 2,577,396 | 12/1951 | Assmundsson | 312/246 X |
| 2,604,762 | 7/1952 | Quinn . | |
| 2,668,423 | 2/1954 | Petkwitz . | |
| 2,769,677 | 11/1956 | Courson et al. | 62/DIG. 11 X |
| 2,799,145 | 7/1957 | Jansen . | |
| 2,801,146 | 7/1957 | Mikulas | 312/345 X |
| 3,633,983 | 1/1972 | Whitcomb . | |
| 3,998,069 | 12/1976 | Kronenberger . | |
| 4,241,668 | 12/1980 | Carroll . | |

FOREIGN PATENT DOCUMENTS

| | | | |
|---|---|---|---|
| 1809753 | 9/1969 | Fed. Rep. of Germany | 312/246 |

*Primary Examiner*—Peter A. Aschenbrenner
*Assistant Examiner*—Thomas A. Rendos
*Attorney, Agent, or Firm*—Radford M. Reams; H. Neil Houser

[57] ABSTRACT

A refrigerator food storage compartment having a shelf assembly, including a pair of vertically extending laterally spaced rail members. A shelf is supported on a pair of horizontally extending arm members which are positioned on the rail members. Carried on the shelf assembly is a secondary food storage arrangement supporting a plurality of containers. The arm members include confronting grooves arranged below the shelf. Slidably arranged in the grooves is a container supporting frame which includes pairs of confronting flanges supporting the containers. Forward travel of the container supporting frame relative to the shelf assembly provides access to the containers. The front portion of the frame includes a front opening through which the containers may be removed while the container supporting frame remains positoned below the shelf.

4 Claims, 3 Drawing Sheets

REFRIGERATOR INCLUDING A SECONDARY FOOD STORAGE ARRANGEMENT

BACKGROUND OF THE INVENTION

The present invention relates to household refrigerators and particularly to a refrigerator cabinet having a secondary food storage arrangement therein.

In producing household refrigerators there is an increasing need to provide food storage cabinets in which food products of various types, shapes and sizes relative to one another may have a proper place of storage therein without materially increasing the size of the food compartment in a cabinet and without unduly sacrificing a part of the storage area or shelf supporting surface within a compartment of predetermined size.

In some prior art attempts of providing storage arrangements for leftover or foods of various types and shapes such as disclosed in U.S. Pat. No. 2,668,423, a single container is arranged in the food compartment of the refrigerator wherein the foods are placed. In U.S. Pat. No. 3,633,983 a unitary shelf and food storage pan support structure is disclosed which is supported on cantilevered shelf brackets. The food storage pan is slidably arranged on the brackets beneath the shelf which is supported on the brackets.

The practice of providing a storage container within a refrigerator cabinet which is slidably mounted beneath a shelf is generally an accepted practice in the household refrigerator industry. Typically when provided these storage containers are intended for bulk storage of a variety of foods. These attempts in providing a food container wherein several types or a variety of foods may be stored is sometimes inconvenient and may result in excessive handling of the stored food. In addition to the excessive handling caused in part by the process of selecting a specific food, the food retrieved must then be placed in another container or vessel where it is to be cooked and/or served.

When a secondary storage system is provided for leftover food it is desirable that it accommodate foods of varying types and sizes. It is further desirable that a plurality of individually retrievable containers be provided so that selected leftover foods may be stored separately, and further that the containers be formed of a material which allows transfer of the selected food container from the refrigerator compartment directly to a cooking appliance or table for serving without transfer of food from the storage container.

SUMMARY OF THE INVENTION

An object of the invention is to provide a secondary food storage arrangement in a refrigerated food compartment of a refrigerator cabinet so as to permit the storage within the food compartment of different types of foods and variously shaped or sized articles in selected individual containers without materially reducing or impairing the total storage capacity of the compartment.

By the present invention a refrigerator including a cabinet having a food storage compartment therein is provided with a secondary food storage arrangement supporting a plurality of individual covered containers. A pair of vertically extending elongated, laterally spaced, parallel rail members including a plurality of vertically spaced receiving apertures are secured to the rear wall of the compartment. A shelf is supported on a pair of horizontally extending shelf support members which are in turn positioned in selected receiving apertures on the rail members. The inner sides of the shelf support members underlying the shelf include confronting support runners. A container supporting frame includes outwardly extending guides which are slidably mounted on the support runners of the supporting frame. The supporting frame includes inwardly extending flanges which removably support the containers, whereby forward horizontal movement of the container supporting frame provides access to the containers supported thereon.

DESCRIPTION OF THE PREFERRED EMBODIMENT

Figure 1:
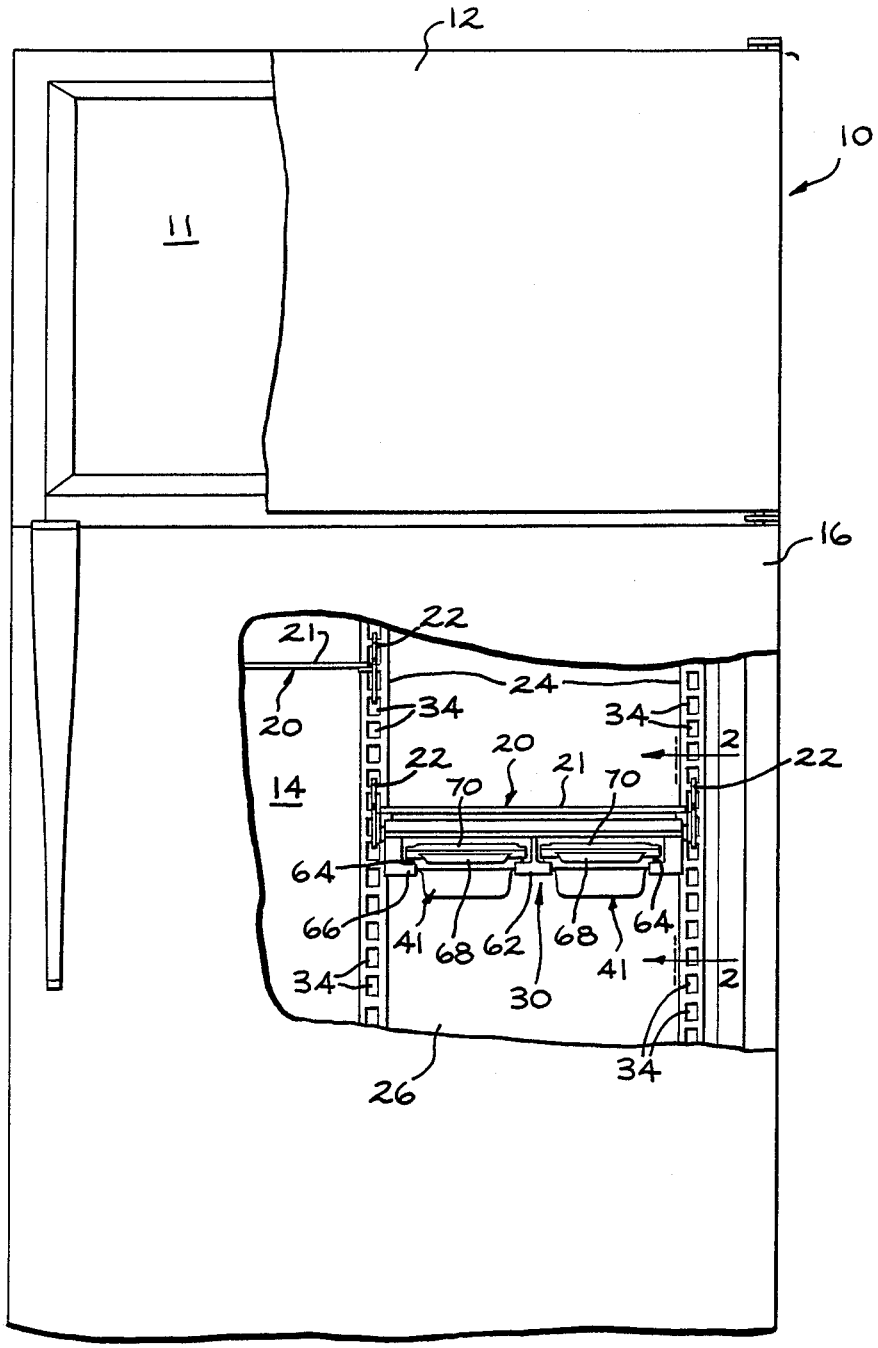
FIG. 1 is a front elevational view of a refrigerator cabinet incorporating the present invention.

With more detailed reference to the drawings and more particularly to FIG. 1 there is illustrated a refrigerator 10 comprising a freezing compartment 11 over which door 12 is closed, and an above-freezing food storage compartment 14 provided with a door 16. Compartment 14 is cooled by forced flow therethrough of relatively cold air from the freezing compartment, in accordance with conventional practice. Storage of foods in compartment 14 is accommodated by a plurality of shelf assemblies designated generally by the reference numeral 20. Each shelf includes cantalevered support brackets of the type seen at 22 and shelf 21 (FIG. 2) is supported on and extends between brackets 22. The brackets are suspended from vertically extending apertured support bars 24 mounted on the rear wall 26 of the compartment.

Figure 2:
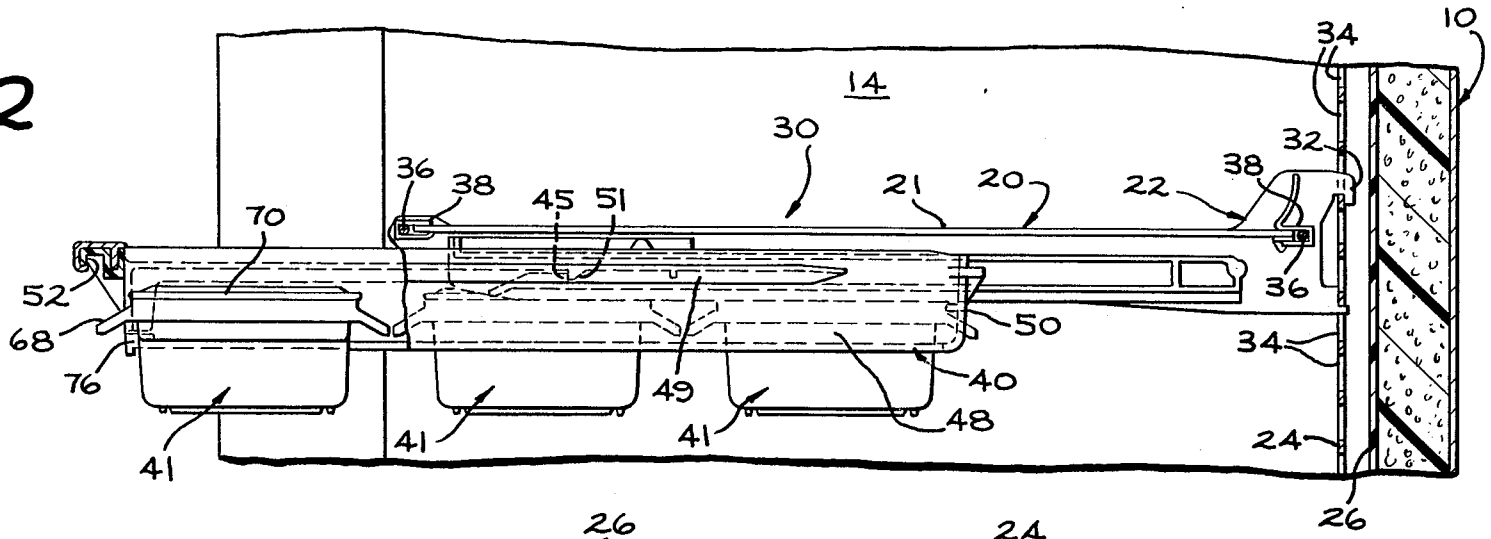
FIG. 2 is a side elevational view, with parts broken away, taken along line 2—2 of FIG. 1.
Figure 4:
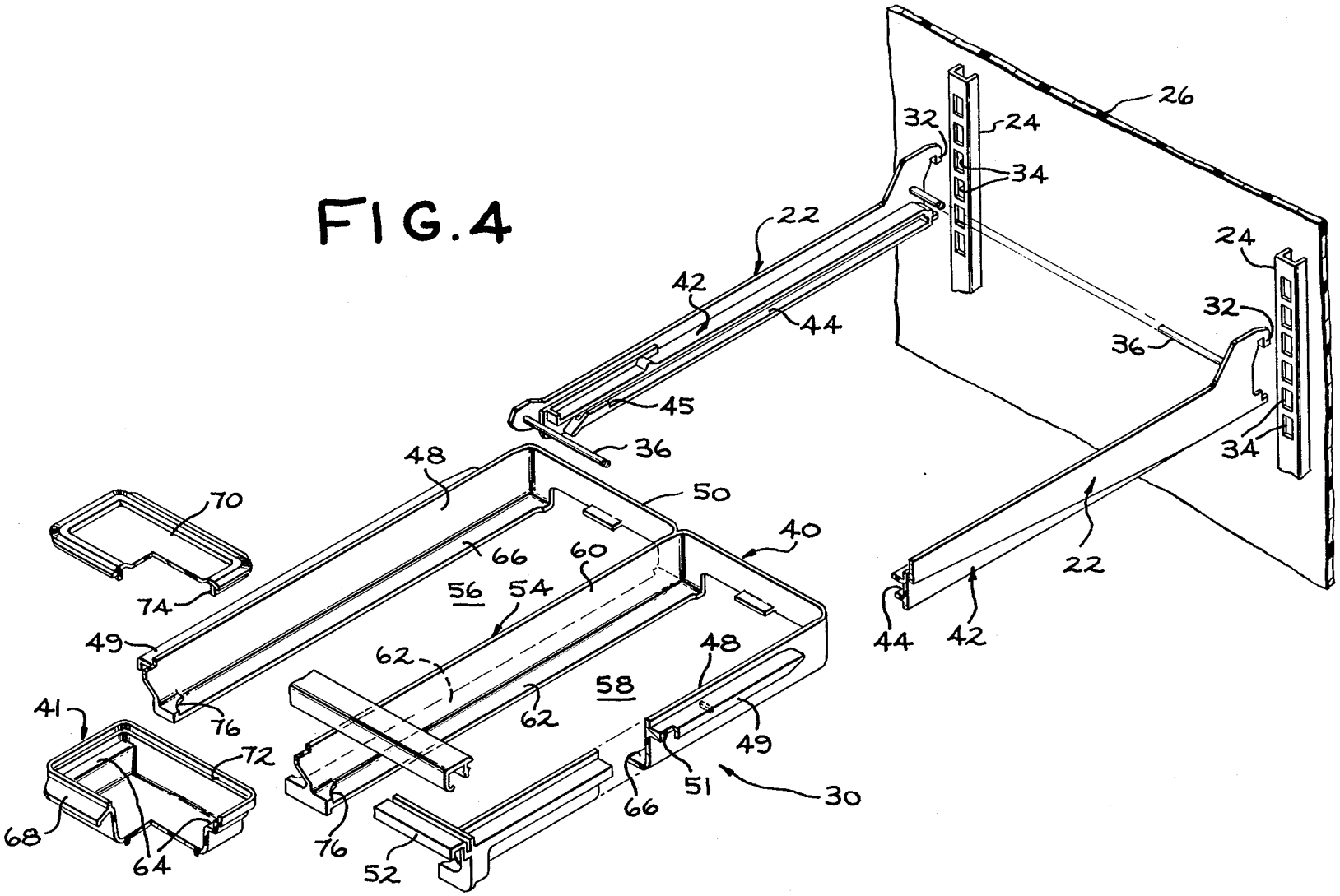
FIG. 4 is an exploded perspective view showing the arrangement of the parts forming the present invention.

The invention is embodied in a combination slidable secondary food storage assembly 30 disposed beneath at least one of the shelf assemblies 20. With reference also to FIGS. 2 and 4 each shelf assembly 20 includes a selected pair of spaced brackets or side plates 22. The brackets 22 are supported, in cantilever fashion, by hooks 32 thereon extending into and engaging edges of apertures 34 in bars 24 as shown in FIG. 2. A pair of transverse bars 36 are affixed at each end to a corresponding portion of a bracket 22, whereby the brackets 22 and bars 36 are handled as a unit. A member 38 of extruded material such as metal or plastic secured to the bars 36 frames the transverse ends of the glass shelf 21. As thus far described the shelf assembly 20 including shelf 21 and brackets 22 arrangement are conventional in design.

Figure 3:
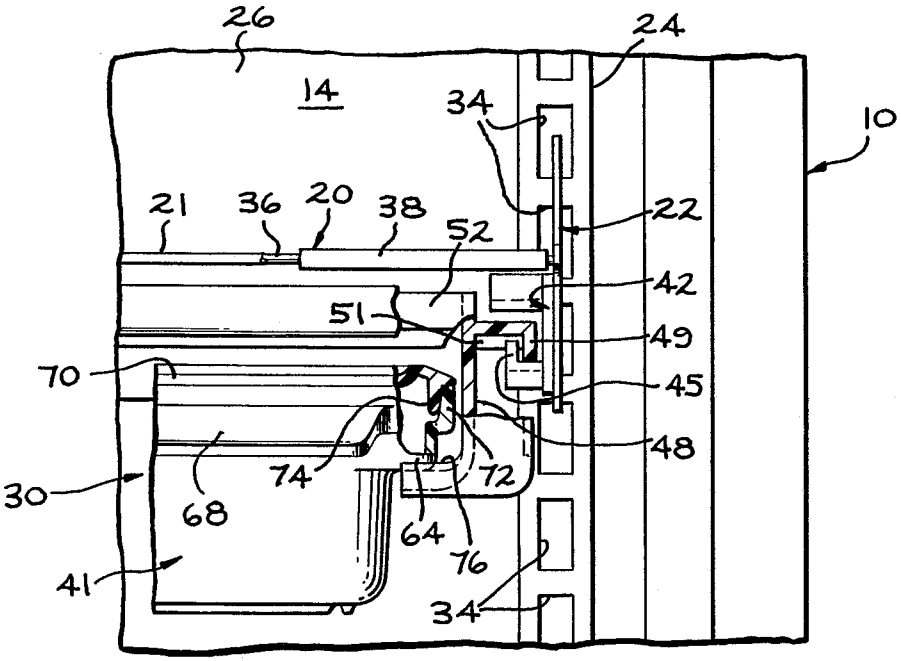
FIG. 3 is a front elevational fragmentary view showing details of the present invention.

The secondary food storage assembly 30 of the present invention is supported generally on the shelf assembly 20 and underlies the shelf 21. To this end each of the brackets 22 supports a runner 42 which extends substantially the full length of the bracket 22. Formed in the runner 42 is a groove 44 that extends substantially the full length of the runner 42 and, as will be explained below, provides for sliding support for the secondary food storage assembly 30. Basically the food storage assembly includes a frame 40 (FIG. 2) and a plurality of containers 41. The frame 40 as will be fully explained hereinafter removeably supports the storage containers 41. The frame 40 includes spaced parallel side wall portions 48 and interconnecting rear and front wall portions 50 and 52 respectively. Each side wall portion 48 includes an outwardly projecting flange 49 which is received in the groove 44 so as to slidably support the frame 40 therefrom. Extending between the rear 50 and front portion 52 at a location intermediate the sides 48 is a divider member 54 which in effect forms two side-by-side support frames 56 and 58. The divider member 54 is formed to include a vertical wall portion 60. Extending outwardly diametric from each side of the vertical wall portion 60 are flanges 62 which project into the frames 56, 58 respectively to thereby confront the side walls 48. The side walls 48 also include inwardly projecting flanges 66 which, as shown in FIG. 2, confront the flanges 62. The confronting flanges 66 and 62 in each frame 56, 58 extend substantially parallel, and as will be explained below removably support the containers 41. To this end two opposite wall portions of the container side wall adjacent the upper end of the container are formed to include outwardly projecting portions 64. The projections 64, as shown in FIGS. 1 and 3, are dimensioned to ride on the flanges 62 and 66 with the main body or depending portion of the container positioned therebetween. The other opposite wall portions of the container side wall adjacent the upper end of the container are formed to provide projecting handles 68 which facilitate the removal of the containers from their position on the flanges 62, 66 of frame 40.

As shown in FIGS. 2 and 4 it will be noted that a front end of the groove 44 includes at its front end an integral vertical projection 45 designed for engagement with a stop member 51 formed on the flange 49 of the side wall portion 48 of frame 40. The engagement between projections 45 and stop members 51 permits sufficient forward movement of the frame 40 to allow removal of selected ones of the containers 41 while at the same time preventing the accidental removal of the frame 40 from the groove 44. With reference to FIG. 2 it will be noted that the vertical dimensions of projection 45 and stop 51 are such that upward movement of the frame 40 will allow disengagement of projection 45 and stop 51 and accordingly removal of frame 40 from the groove 44 and accordingly from shelf assembly 20. This flexibility permits the user to remove all of the containers from the compartment 14, if desired.

The storage containers 41 in the present instance are microwaveable, dishwasher safe and are sealed by a cover 70. The cover 70 and the upper edge of the container 41 are dimensioned in a manner that inhibits substantial food dehydration and, therefore, helps them to remain fresh. To this end, as shown best in FIGS. 3 and 4, the upper edge portion of the container side wall is provided with a continuous lip 72 which receives a depending portion 74 of cover 70 to form a relatively airtight seal therebetween. In order to permit removal of the container 41 without moving the frame 40 relative to the shelf assembly 20, the front cross portion 52 of frame 40 as seen in FIGS. 3 and 4 is located and connected to the upper portion of the side walls 48. This position of cross portion 52 at the upper portion of side walls 48 in effect provides a front opening below portion 52 through which the containers 41 may be moved forwardly on the flanges 62, 66 and accordingly removed from frame 40 while the frame remains in its position underlying the shelf 21.

The front end portion of the flanges 62 and 66 are provided with a projection 76 which engages the portion 64 of containers 41. The containers when positioned in the frame 40 as shown in FIG. 2 are generally rearwardly of the projection 76. This arrangement requires that the containers in order to be removed from frame 40 be lifted so that the portions 64 thereof are above the projection 76. This arrangement prevents inadvertent removal of the containers from the frame 40.

While the divider 52 as shown in the present embodiment divides the frame 40 into substantially equally sized individual frames 56 and 58, it should be noted that the divider may be located laterally at any convenient position between side walls 48. For example, it may be desirable to locate divider 52 so that the individual frames 56 and 58 can accept containers of different sizes. Such an arrangement would allow the user greater flexibility in selecting containers in accordance with the volume of food to be stored.

In summary, by the present invention a storage arrangement is provided wherein relatively small quantities of various types of leftover food may be stored in separate containers whereby the selected and leftover food and its container may be removed and placed in a cooking appliance for reheating, if required, or directly to the table for serving.

Further, the present leftover food storage arrangement allows access to the individual containers by sliding the frame 40 outwardly relative to the shelf assembly 20, whereby a selected container may be removed or alternatively containers may be removed from the frame 40 by merely sliding them out of the frame 40 between the flanges 62, 66 and cross member 52.

It should be apparent to those skilled in the art that the embodiment described heretofore is considered to be the presently preferred form of this invention. In accordance with the Patent Statutes, changes may be made in the disclosed apparatus and the manner in which it is used without actually departing from the true spirit and scope of this invention.

What is claimed is:

1. A refrigerator including:

a cabinet having a food storage compartment therein;

a pair of elongated, vertically extending, laterally spaced, parallel rail members secured to said cabinet;

a pair of elongated, horizontally extending, laterally spaced, parallel shelf support members supported on said rail members;

a horizontally disposed shelf supported from and extending between said shelf support members;

a secondary food storage system for removably supporting a plurality of containers having outwardly extending mounting projections;

said secondary food storage system including means on said pair of shelf support members underlying said shelf and defining horizontally extending, spaced apart confronting support runners independent of the support of said shelf;

container support frame means including laterally spaced apart side members having flange means extending outwardly therefrom for slidably engaging said confronting support runners for removably mounting said support frame independent of said shelf;

said side members of said container support frame means including inwardly extending spaced apart, confronting support flanges for engaging the mounting projections of containers placed therebetween to removeably support the containers in said support frame means;

said support frame means further including diverging flange means intermediate said support flanges on said side members for providing removable support for adjacent rows of containers;

said support frame means being open along its front edge to permit containers to slide horizontally relative to said support frame means for removal from said support frame means; and forward horizontal movement of said support frame means from its position underlying said shelf exposes said support frame means to thereby provide access to the container support in said support frame means.

2. The refrigerator recited in claim 1 wherein a projection on at least one of said support runners engages stop means on the corresponding side member of said support frame means for releasably retaining said support frame means relative to said shelf support members.

3. The refrigerator recited in claim 2 wherein projections are provided on said support flanges of said support frame means for engaging containers placed in said support frame means for releasably retaining such containers in said support frame means.

4. The refrigerator recited in claim 3 wherein said rail members include a plurality of vertically spaced receiving means, and said shelf support members include hook portions on one end thereof arranged in selected ones of said receiving means.

* * * * *